US006543370B2

(12) United States Patent
Bae

(10) Patent No.: US 6,543,370 B2
(45) Date of Patent: Apr. 8, 2003

(54) STACKABLE PALLET

(75) Inventor: In Kyu Bae, Chula Vista, CA (US)

(73) Assignee: Hyundai Translead, Inc., San Diego, CA (US)

( * ) Notice: Subject to any disclaimer, the term of this patent is extended or adjusted under 35 U.S.C. 154(b) by 0 days.

(21) Appl. No.: 09/826,832

(22) Filed: Apr. 6, 2001

(65) Prior Publication Data

US 2001/0035113 A1 Nov. 1, 2001

Related U.S. Application Data

(60) Provisional application No. 60/195,194, filed on Apr. 7, 2000.

(51) Int. Cl.[7] ..... B65D 19/44
(52) U.S. Cl. ..... 108/55.1
(58) Field of Search ..... 108/55.1, 55.5, 108/53.3, 53.1, 54.1, 51.11, 57.16

(56) References Cited

U.S. PATENT DOCUMENTS

| | | | | |
|---|---|---|---|---|
| 2,936,985 A | | 5/1960 | Doerr et al. | |
| 2,956,763 A | | 10/1960 | D'Arca | |
| 3,402,845 A | | 9/1968 | Eriksson | |
| 3,499,398 A | | 3/1970 | Murray | |
| 3,620,388 A | | 11/1971 | Mansson | |
| 3,735,713 A | | 5/1973 | Glassmeyer | |
| 4,131,071 A | | 12/1978 | Glassmeyer | |
| 4,240,359 A | | 12/1980 | Howe | |
| 4,314,686 A | | 2/1982 | Marz | |
| 4,353,520 A | | 10/1982 | Jansson | |
| 4,435,028 A | | 3/1984 | Rivkin | |
| 4,674,647 A | | 6/1987 | Gyenge et al. | |
| 5,284,266 A | | 2/1994 | Januel et al. | |
| 5,639,174 A | | 6/1997 | Gonska | |
| 5,644,992 A | * | 7/1997 | Clive-Smith | |
| 5,676,065 A | * | 10/1997 | Locker | |
| 5,720,228 A | * | 2/1998 | Clive-Smith | |
| 5,755,472 A | * | 5/1998 | Clive-Smith | |
| 5,983,806 A | | 11/1999 | Brennan, Jr. et al. | 108/53.1 |
| 6,202,569 B1 | * | 3/2001 | Bailey et al. | 108/53.5 |

FOREIGN PATENT DOCUMENTS

| | | |
|---|---|---|
| GB | 2265603 | 10/1993 |

* cited by examiner

*Primary Examiner*—Jose V. Chen
(74) *Attorney, Agent, or Firm*—Morgan, Lewis & Bockius LLP

(57) ABSTRACT

A stackable pallet can include a rectangular planar base member having a first end, a second end, and two opposing sides. A slider pad can extend downwardly from the base member adjacent the first end. A handle member can be pivotally secured to the base member adjacent the first end by a hinge member. The hinge member preferably has a partial U-shaped hinge housing, an L-shaped hinge plate, a pivot pin, a locking pin bore and a locking pin. The handle member can be adapted to be pivoted from an inoperative position, wherein the handle member is folded on top of the base member, to a first operative position, wherein the handle member extends upwardly from the base member, and to a second operative position, wherein the handle member extends in a direction opposed from the inoperative position such that the handle member and the base member are substantially planar.

16 Claims, 4 Drawing Sheets

STACKABLE PALLET

This Application claims the benefit of U.S. Provisional Patent Application Ser. No.: 60/195,194 filed Apr. 7, 2000, which is incorporated herein by reference.

BACKGROUND OF THE INVENTION

1. Field of the Invention

The invention relates to a stackable pallet, and more particularly to a pallet adapted for use with conventional truck vehicle pallet load and unload systems (PLS) that can be stacked on top of an adjacent pallet when not in use.

2. Discussion of the Related Art

In order to efficiently transport cargo, the shipping, transport and materials handling industries have employed pallets for holding cargo. Typically, pallets include a large planer surface capable of holding a large volume of cargo. Once filled with cargo, the pallets are placed onto conveyances, transported to a given destination and then removed from the conveyance to be unloaded.

In order to facilitate loading and unloading on the conveyance, conventional pallets may employ a handle or lever arm positioned at one end of the base of the pallet that is disposed perpendicular to the surface of the pallet. The handle is typically affixed to the pallet and can be used to lift and move the pallet. In some conventional stackable pallets, the handle can pivot 90° from an upright position to a rest position in contact with the pallet surface.

SUMMARY OF THE INVENTION

As described above, conventional stackable pallets provide a handle member that can be retracted and placed in contact with the pallet surface when not in use. However, the conventional stackable pallet's handles are restricted to a 90° range of motion and, thus, cannot easily be pulled in a horizontal direction. The invention overcomes the deficiencies in conventional stackable pallet systems and provides a foldable, stackable pallet that can be efficiently stacked with other pallets when not in use, and that has a handle capable of at least a full 180° range of motion.

It is therefore an object of the invention to provide a stackable pallet that can be compactly stacked on top of another pallet when not in use.

It is a further object of the invention to provide a handle, pivotable about the base of the pallet, having at least a 180° range of motion, thus allowing the pallet to be pulled in a horizontal direction.

It is a further object of the invention to provide a partial U-shaped hinge structure that facilitates a 180° range of motion by the handle.

It is a further object of the invention to provide a tapered locking pin that facilitates fixing and locking the handle in an upright position, approximately 90° from the base of the pallet.

In accordance with the illustrative embodiments, the invention provides a stackable pallet having a rectangular planar base member. The base member has two opposing ends and two opposing sides. Pivot means, including two hinge members, can be formed at one end of the base member. A handle member is pivotably secured to the base member, via the two hinges. The handle member is made up of two handle arms. The handle arms gradually converge and are connected by a connecting member to form an "A" frame. The entire handle has a full 180° range of motion with respect to the base of the pallet. In operation, the handle may be raised upright to an approximately 90° angle with respect to the base of the pallet and locked in place using a fastening means. Cargo may be loaded and secured onto the base of the pallet and a loading apparatus can grasp the handle and raise and/or move the pallet to a transport vehicle. When the pallet is unloaded, the handle can be retracted back into its rest position against the base of the pallet. In this position, the pallet has a compact shape that allows stacking multiple pallets on top of one another. The invention also provides that the handle can rotate 180° from its rest position, thus being positioned in the same horizontal plane as the base of the pallet. In this configuration, the pallet can be pulled in a horizontal direction.

In accordance with another aspect of the invention, a pallet can include a planar base member having a first end, a second end, and two opposing sides, a slider pad extending downwardly from the base member adjacent the first end, and a handle member pivotally secured to the base member adjacent the first end by a hinge member. The handle member can be adapted to be pivoted from an inoperative position, wherein the handle member is folded on top of the base member, to a first operative position, wherein the handle member extends upwardly from the base member, and to a second operative position, wherein the handle member extends in a direction opposed from the inoperative position. A method for using such a pallet can include the steps of pivoting the handle member from one of the first operative position and the inoperative position to the second operative position wherein the handle member extends away from the base member, and pulling the pallet via the handle member such that a force acting substantially coplanar to the base member is applied to the pallet to cause the pallet to move.

In accordance with yet another aspect of the invention, a pulling force resulting from a predetermined force applied to the handle when in the second operative position can be greater than a pulling force resulting from that same predetermined force being applied to the handle when in the first operative position. Thus, the pallet can be moved with greater ease due to the force distribution resulting from the handle configuration.

BRIEF DESCRIPTION OF THE DRAWINGS

The invention is described in relation to the following drawings, which are included to provide a further understanding of the invention and which are incorporated in and constitute a part of this specification. The accompanying drawings illustrate a preferred embodiment of the invention and together with the description serve to explain the principles of the invention. In the accompanying drawings, like reference symbols refer to like elements, wherein.

DETAILED DESCRIPTION OF THE PREFERRED EMBODIMENTS

Figure 1:
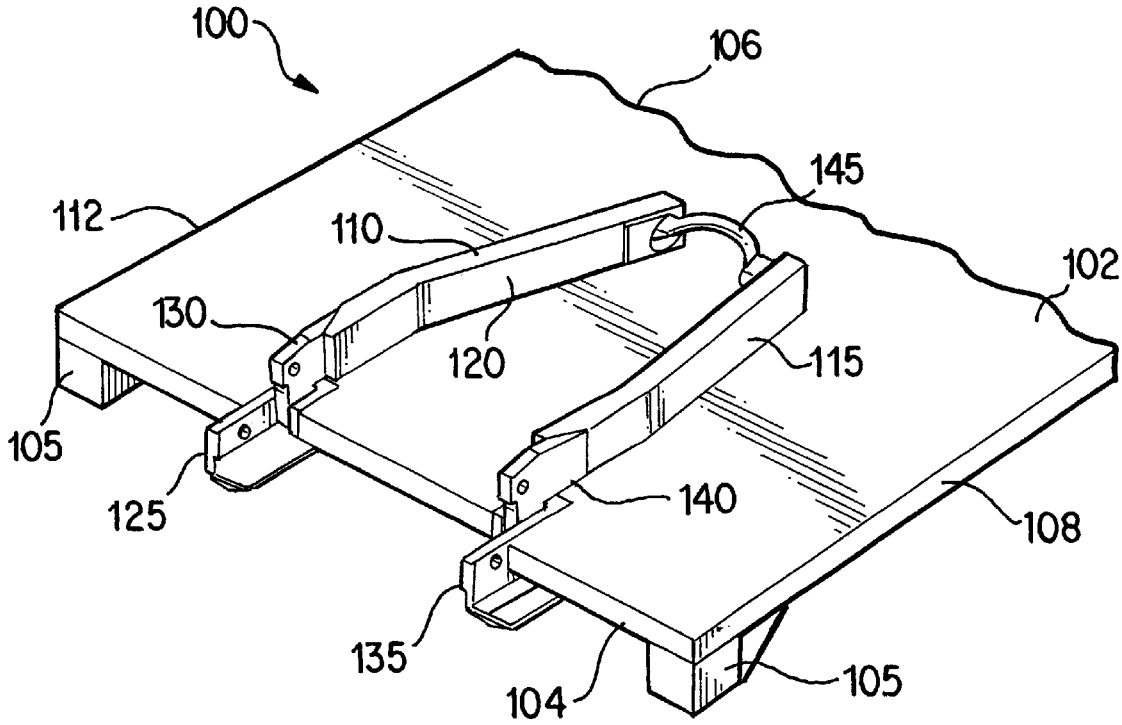
FIG. 1 is a perspective view of a stackable pallet in accordance with an embodiment of the invention.

FIG. 1 shows a perspective view of the stackable pallet according to an embodiment of the invention. The stackable pallet 100 can include a rectangular planar base member 102. The base member has a first end 104, a second end 106, a first opposing side 108 and a second opposing side 112. Two slider pads 105 can be provided at opposite sides of the first end 104. The slider pads facilitate sliding the pallet 100 when it is lifted or pulled by handle 110.

FIG. 1 also shows two hinge housings 125 and 135 that can be formed into the first end 104 of the base member 102. The hinge housings 125 and 135 preferably have a semi-U-shaped configuration and may be mounted onto the base member 102 by first cutting a segment out of the base member 102 large enough to fit the hinge housings 125 and 135. Once fitted into the first end 104 of the base member 102, the hinge housings can be welded, bolted or otherwise affixed to the base member 102. The hinge housings 125 and 135 can both extend outward and away from the first end 104. At least one screw hole may be machined through the extended portion of each of the hinge housings 125 and 135.

FIG. 1 also shows the handle 110 its rest position. The handle 110 preferably includes two handle arms 120 and 115 that converge to form an "A" frame. The handle arms 120 and 115 can be connected to each other by a connecting member 145. The unconnected ends of each of the handle arms 120 and 115 can each include a hinge plate 130 and 140. The hinge plates 130 and 140 are preferably L-shaped plates adapted to fit into the opening created by the semi-U-Shaped hinge housings 125 and 135. For example, hinge plate 130 fits into the opening created by the hinge housing 125 and is then fastened with a fastening means, such as a locking pin, screw, bolt, etc. Thus, the hinge plates 130 and 140 and the hinge housings 125 and 135 engage, forming a hinge mechanism (described later in greater detail). The handle 110, therefore, can be pivotally mounted to the base member 102 and capable of freely rotating at least 180° from its rest position.

Figure 2:
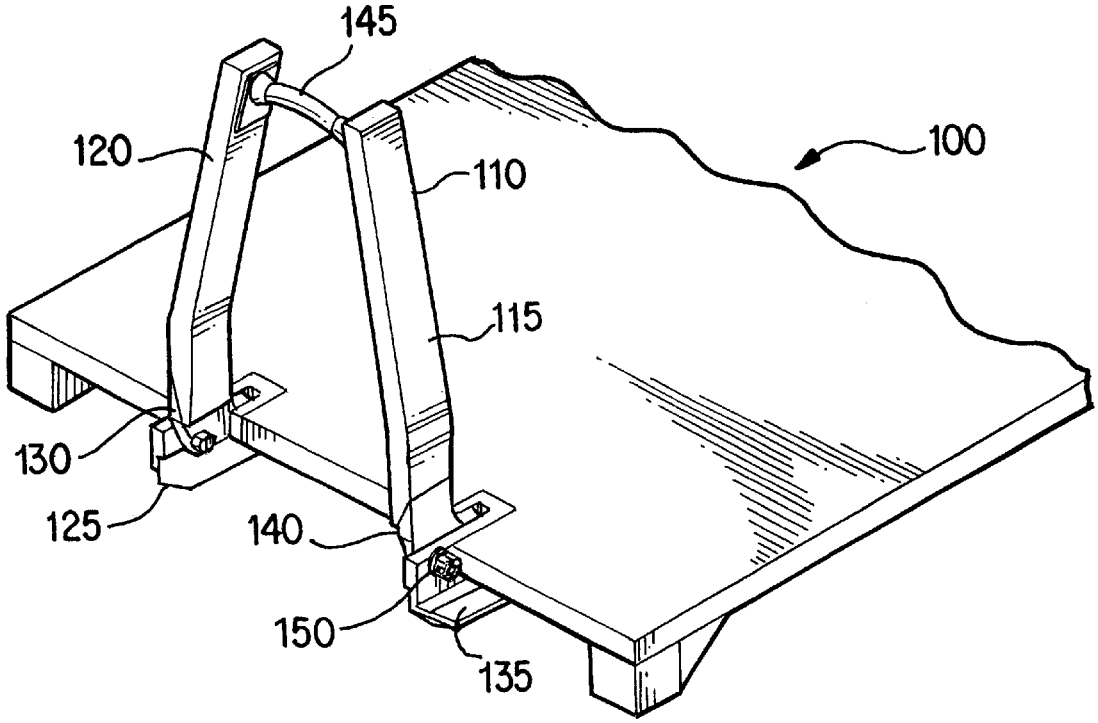
FIG. 2 is a perspective view of the stackable pallet illustrated in FIG. 1 showing the handle in an upright position.

FIG. 2 shows the stackable pallet of FIG. 1, whereby the handle is rotated upright 90° from its rest position. The handle 110 can be in an upright position allowing cargo loading. In this upright configuration, the handle 110 can be held rigidly in place by two locking pins 150. Thus, pallet 100 can be securely grasped and lifted during loading and unloading.

Figure 3:
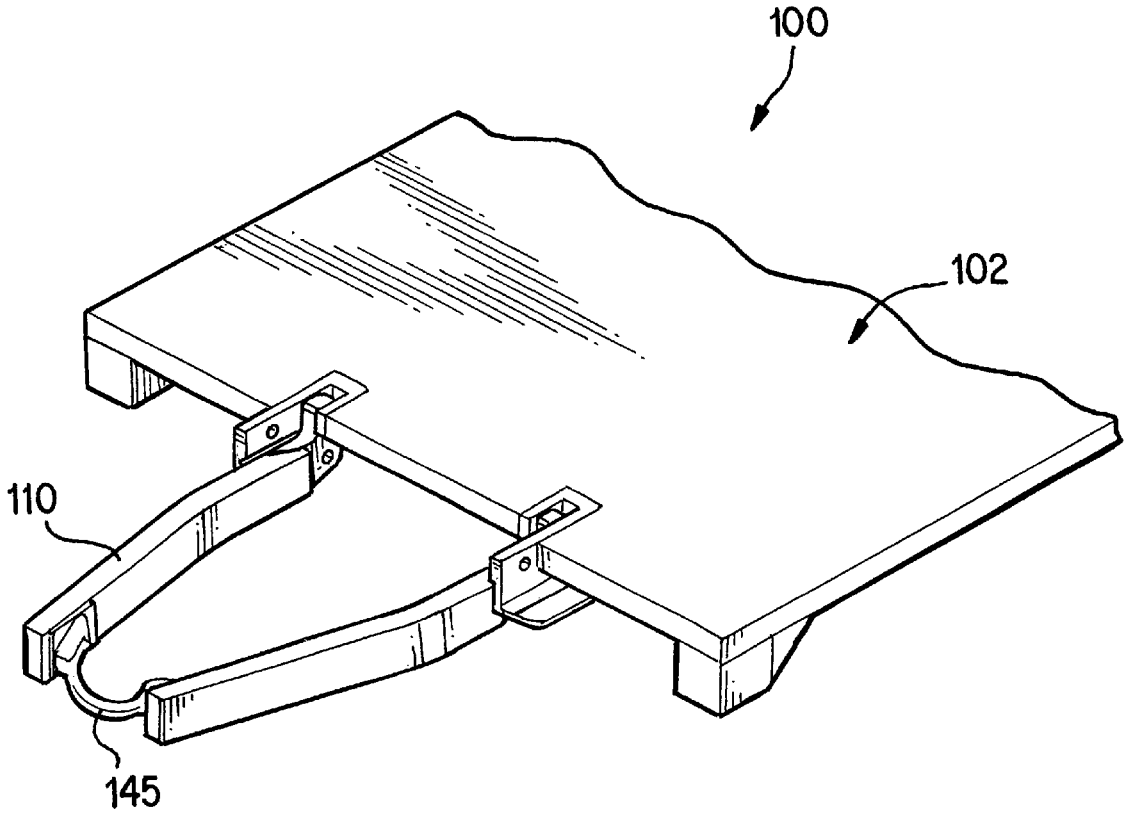
FIG. 3 is a perspective view of the stackable pallet illustrated in FIG. 1 showing the handle rotated 180° away from the rest position.

FIG. 3 shows the stackable pallet 100 of FIGS. 1 and 2 with the handle member 110 rotated 180° from its rest position, so as to be horizontal to the surface of the base member 102. As shown in FIG. 3, the handle 110 can be pivoted 180° from the rest position, thus projecting outward and away from the first end 104 of the base member 102. In this configuration, the handle 110 is disposed in the same horizontal plane as the base member 102, thus allowing the pallet 100 to be pulled in a horizontal direction.

The pivoting handle configuration permits a greater pulling force (e.g., force directed substantially coplanar to the base member which causes the pallet to move) to be applied to the pallet than if the handle remains locked in the 90° position with respect to the base member 102.

Figure 4:
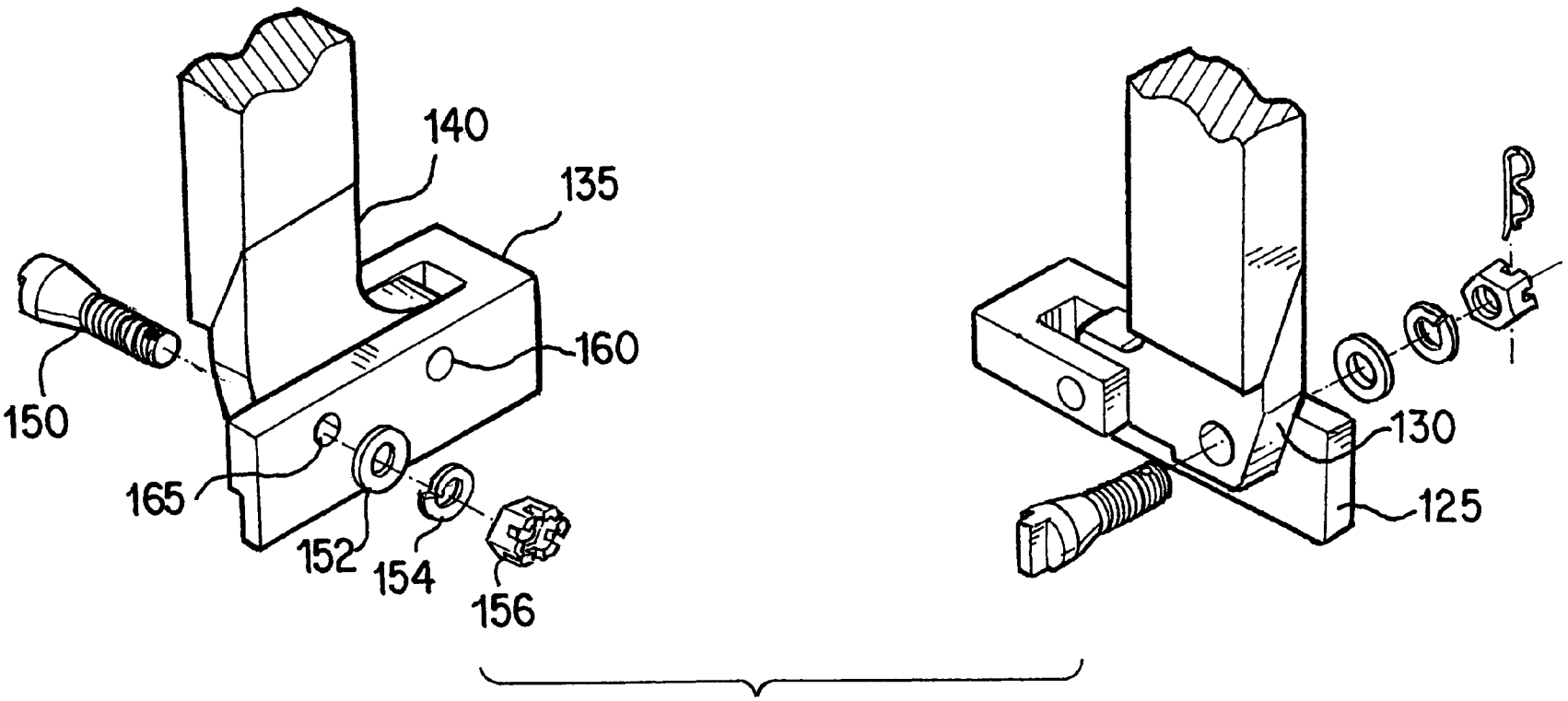
FIG. 4 is an exploded view of the hinge mechanism and locking pin shown in FIG. 2.

FIG. 4 shows the hinge housing 135 and hinge plate 140 in greater detail. The hinge housing 135 preferably has a semi-u-shape that is capable of receiving the hinge plate 140. A hinge hole 160 can be machined into the hinge housing 135 and aligned with a hinge hole (not shown) formed into the hinge plate 140. These hinge holes can be aligned and fitted together with a fastening means (not shown). Thus, the hinge plate 140 is pivotally affixed to the hinge housing 135. This hinge mechanism thus allows the handle to rotate at least 180° from its rest position. In addition, as shown in FIG. 4, the hinge plate has a screw hole (not shown) which preferably aligns with a second screw hole 165 formed in the hinge bracket 135 when the handle is rotated to an upright position (approximately 90° from the rest position). The handle can therefore be fixed in the upright position by installing a fastening means, such as a locking pin 150, that secures the hinge housing 135 to the hinge plate 140 using washers 152 and 154 and locking nut 156. The locking pin 150 may have a tapered profile that securely fixes the hinge plate 140 to the hinge housing 135.

In order to facilitate further understanding of the invention, its operation is briefly described. FIG. 1 shows the stackable pallet in non-operational mode. In this mode, the handle 110 is in a rest position sitting on the surface of base member 102. This allows the pallets to be stacked on top of each other in a manner in which each pallet securely fits against an adjacent pallet in a compact fashion.

If the pallet 100 is ready to be loaded with cargo, the handle 110 is first rotated to at least an upright position, as shown in FIG. 2. In this configuration, the entire surface of base member 102 is free for receiving cargo. As described above in connection with FIG. 4, the handle can be fixed in the upright position using a locking pin 150. Once the pallet 100 is filled with cargo, it can be loaded to a transport vehicle. A loading mechanism is typically employed for this task. The loading mechanism can grasp the handle 110 at the connector segment 145 and can lift and pull the pallet as necessary. Similarly, during unloading, the loading mechanism can grasp the handle 110 of the pallet 100 and remove the pallet 100 from the transport vehicle for unloading.

In addition, the invention provides that the handle 110 can be rotated at least 180° from its rest position. This allows for the pallet 100 to be pulled in a horizontal or other range of directions. For example, if a pallet is located on an inclined surface and needs to be pulled up to an elevated highway, the handle 110 can be rotated such that it aligns with the base member 102 (approximately 180° from the rest position), and the transport vehicle can pull the pallet 100 up the incline with a pulling force that is applied coplanar with the base member 102. Moreover, whenever a pulling force applied to the base member 102 is needed, rotation of the handle 110 will facilitate application of such a force.

While the invention has been described in conjunction with specific embodiments thereof, it is evident that many alternatives, modifications and variations will be apparent to those skilled in the art.

For example, the base member 102 of pallet 100 is shown as being rectangular in shape. However, it is within the scope of the invention to provide a base member 102 that is round, square or other shape as necessitated by a particular application for the invention. In addition, the handle could be square, rectangular, round or even bar-shaped without departing from the spirit and scope of the invention. The pivot means can include hinge plates 130, 140 and hinge housings 125, 135 which can be different shapes than those shown and can be combined into a single hinge/hinge housing if necessary. The hinge housings 140 could also be integral portions of the base member 102.

Accordingly, the preferred embodiments of the invention set forth herein are intended to be illustrative, not limiting. Various changes may be made without departing from the spirit and scope of the invention.

What is claimed is:

1. A stackable pallet, comprising:

a planar base member having a first end, a second end, and two opposing sides;

a slider pad extending downwardly from the base member adjacent the first end;

a handle member for grasping pivotally secured to the base member adjacent the first end, the handle member adapted to be pivoted from an inoperative position, wherein the handle member is folded on top of the base member, to a first operative position, wherein the handle member extends upwardly from the base member, and to a second operative position, wherein the handle member extends in a direction opposed from the inoperative position such that the handle member and the base member are substantially coplanar.

2. The stackable pallet of claim 1, wherein the handle member is pivotally secured to the base member by a hinge member.

3. The stackable pallet of claim 2, wherein the hinge member includes a pivot pin member, a partial U-shaped hinge housing and an L-shaped hinge plate adapted to pivot about the pivot pin member relative to the partial U-shaped hinge housing.

4. The stackable pallet of claim 2, wherein the handle member is pivotally secured to the base member by a second hinge member, wherein the handle member includes first and second converging handle arms and a connecting member formed between the handle arms and connecting the handle arms, one of the first and second handle arms secured to the hinge member, the other of the first and second handle arms secured to the second hinge member.

5. The stackable pallet of claim 4, wherein the hinge member includes a pivot pin member, a partial U-shaped hinge housing and an L-shaped hinge plate adapted to pivot about the pivot pin member relative to the partial U-shaped hinge housing, and wherein the second hinge member includes a second pivot pin member, a second partial U-shaped hinge housing and a second L-shaped hinge plate adapted to pivot about the second pivot pin member relative to the second partial U-shaped hinge housing.

6. The stackable pallet of claim 5, wherein the partial U-shaped hinge housing and the L-shaped hinge plate further include a portion defining a locking pin bore;

the second partial U-shaped hinge housing and the second L-shaped hinge plate further include a portion defining a second locking pin bore;

the hinge member further includes a locking pin, the locking pin extending through the locking pin bore and locking the L-shaped hinge plate and the partial U-shaped hinge housing; and the second hinge member further includes a second locking pin, the second locking pin extending through the second locking pin bore and locking the second L shaped hinge plate and the second U-shaped hinge housing, such that the handle member is in the first operative position.

7. The stackable pallet of claim 3, wherein the partial U-shaped hinge housing is secured to the base member, and the handle member is secured to the L-shaped hinge plate.

8. The stackable pallet of claim 7, wherein the partial U-shaped hinge housing and the L-shaped hinge plate further include a portion defining a locking pin bore, and the hinge member further includes a locking pin, the locking pin extending through the locking pin bore and locking the L-shaped hinge plate and the partial U shaped hinge housing such that the handle member is in the first operative position.

9. A method of using a pallet that includes a planar base member having a first end, a second end, and two opposing sides, a slider pad extending downwardly from the base member adjacent the first end, and a handle member for grasping pivotally secured to the base member adjacent the first end by a hinge member, the handle member adapted to be pivoted from an inoperative position, wherein the handle member is folded on top of the base member, to a first operative position, wherein the handle member extends upwardly from the base member, and to a second operative position, wherein the handle member extends in a direction opposed from the inoperative position, the method including the steps of:

pivoting the handle member from one of the first operative position and the inoperative position to the second operative position wherein the handle member extends away from the base member; and pulling the pallet via the handle member such that a pulling force acting substantially coplanar to the base member is applied to the pallet to cause the pallet to move.

10. The method of claim 9, wherein the step of pivoting includes pivoting the handle member to the second operative position wherein the handle member extends away from the base member and is substantially coplanar with the base member.

11. The method of claim 9, further comprising:

locking the handle member at the first operative position; and picking up the pallet via the handle member when the handle member is locked in the first operative position.

12. The method of claim 9, wherein the handle is approximately at a right angle with respect to the base member when in the first operative position.

13. A stackable pallet, comprising:

a planar base member having a first end, a second end, and two opposing sides;

a slider pad extending downwardly from the base member adjacent the first end;

a handle member for grasping pivotally secured to the base member adjacent the first end, the handle member including pivot means for pivoting the handle from an inoperative position, wherein the handle member is folded on top of the base member, to a first operative position, wherein the handle member extends upwardly from the base member, and to a second operative position, wherein the handle member extends in a direction opposed from the inoperative position, such that a first pulling force on the pallet resulting from a predetermined force applied to the handle when in the second operative position is greater than a second pulling force on the pallet resulting from the predetermined force applied to the handle when in the first operative position.

14. The stackable pallet of claim 13, wherein the pivot means includes a hinge member.

15. The stackable pallet of claim 14, wherein the hinge member includes a pivot pin member, a partial U-shaped hinge housing and an L-shaped hinge plate adapted to pivot about the pivot pin member relative to the partial U-shaped hinge housing.

16. The stackable pallet of claim 15, wherein the partial U-shaped hinge housing and the L-shaped hinge plate further include a portion defining a locking pin bore, and the hinge member further includes a locking pin, the locking pin extending through the locking pin bore and locking the L-shaped hinge plate and the partial U-shaped hinge housing such that the handle member is in the first operative position.

* * * * *